US006619072B2

(12) United States Patent
Seki et al.

(10) Patent No.: US 6,619,072 B2
(45) Date of Patent: Sep. 16, 2003

(54) TURBOCOMPRESSOR AND REFRIGERATING MACHINE

(75) Inventors: Wataru Seki, Takasago (JP); Akihiro Takemoto, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/918,478

(22) Filed: Aug. 1, 2001

(65) Prior Publication Data

US 2002/0014088 A1 Feb. 7, 2002

(30) Foreign Application Priority Data

Aug. 2, 2000 (JP) ..... 2000-234558

(51) Int. Cl.[7] ..... F25B 31/00; F25B 1/00
(52) U.S. Cl. ..... 62/498; 62/505
(58) Field of Search ..... 62/498, 469, 505; 417/366, 350, 371, 56, 143

(56) References Cited

U.S. PATENT DOCUMENTS

| | | | | |
|---|---|---|---|---|
| 3,784,318 A | | 1/1974 | Davis | |
| 4,257,733 A | | 3/1981 | Bandukwalla et al. | |
| 4,378,194 A | | 3/1983 | Bandukwalla | |
| RE31,259 E | * | 5/1983 | Gopalakrishnan et al. | 415/56 |
| 4,416,583 A | | 11/1983 | Byrns | |
| 4,932,835 A | | 6/1990 | Sorokes | |
| 5,116,197 A | | 5/1992 | Snell | |
| 6,009,722 A | * | 1/2000 | Choi et al. | 62/505 |
| 6,155,802 A | * | 12/2000 | Choi et al. | 417/366 |

FOREIGN PATENT DOCUMENTS

| | | |
|---|---|---|
| CH | 677 956 | 7/1991 |
| EP | 0 099 847 | 2/1984 |
| WO | WO 99/58858 | 11/1999 |

* cited by examiner

*Primary Examiner*—Melvin Jones
(74) *Attorney, Agent, or Firm*—Oblon, Spivak, McClelland, Maier & Neustadt, P.C.

(57) ABSTRACT

The invention is aimed at making a space necessary for installing an adjusting mechanism for a diffuser small to thereby miniaturize a turbocompressor as well as a refrigerating machine where this turbocompressor is a constituent element.

A compressor incorporating a diffuser 34 adopts an adjusting mechanism comprising; a diffuser ring 37 forming one wall 34*a*, arranged so as to be a concentric circle with the surroundings of a second stage impeller 17*b* and supported on a casing 25, and which can be rotated in the circumferential direction and which can be moved in an axial direction of the second stage impeller 17*b*, with a groove 37*a* formed on an outer peripheral face at an incline to the axial direction of the second stage impeller 17*b*; a protrusion 40 provided on the casing 25 and fitted into the groove 37*a*; a shaft 38 axially supported on the diffuser ring 37; and a drive section 39 for driving the shaft 38 in a lengthwise direction.

6 Claims, 12 Drawing Sheets

TURBOCOMPRESSOR AND REFRIGERATING MACHINE

BACKGROUND OF THE INVENTION

1. Field of the Invention

The present invention relates to a diffuser applicable to a turbocompressor such as a radial compressor and the like, a turbocompressor incorporating this diffuser, and a refrigerating machine with this turbocompressor as a constituent element.

2. Description of the Related Art

In a turbocompressor such as a radial compressor, there is provided a diffuser for reducing the velocity of a fluid to convert kinetic energy held by the fluid into internal energy. One example of a turbocompressor provided with a diffuser is shown in FIG. 11. In the figure, reference symbol 1 denotes a casing, 2 a main shaft, 3 an impeller, 4 a diffuser section, 5 a return bend, 7 a guide vane, and 8 an inlet port. In the diffuser section 4 there is provided in combination; a diffuser 9 which has no vanes, and a vane diffuser 10 having a plurality of vanes 10*a* arranged spaced at equal intervals on an outer peripheral section of the diffuser 9.

A fluid to be compressed by the turbocompressor is sucked in from the inlet port 8 as shown by the white arrow in the figure, and is then sequentially passed through the impeller 3, the diffuser section 4, the return bend 5, and the guide vanes 7, and increased in pressure, and then introduced to the next stage inlet.

However, in the conventional turbocompressor, the inlet angle of the fluid to the diffuser section 4 is changed when the intake flow rate of fluid for the impeller 3 is changed. Therefore, for example even if an optimum diffuser effect is obtained where at a certain intake flow rate the flow direction of the discharged fluid from the impeller 3 coincides with the set direction of the vanes 10*a,* there is the case where if the intake flow rate is changed, then both of these directions no longer coincide so that a sufficient diffuser effect is not obtained.

Therefore, in the aforementioned turbocompressor, one wall 9*a* constituting the diffuser 9 is made so as to be able to approach or separate from the other wall 9*b* to enable the effectiveness of the diffuser 9 to be adjusted. Hence even though the intake flow rate of fluid to the later stage vane diffuser 10 with which this is combined changes, an optimum diffuser effect is obtained.

An adjusting mechanism for the diffuser 9 is shown in FIG. 12. In the figure, reference symbol 11 denotes a diffuser ring, 12 a drive ring, 13 a connecting shaft, and 14 a drive ring lever. As for the diffuser ring 11, one side face constitutes the wall 9*a*, and this wall 9*a* is exposed to the passage and is built in to the casing 1. On the outside of the casing 1 is arranged a drive ring 12 made concentric with the center of the diffuser ring 11, and both of these are connected by a connecting shaft 13 passing through an aperture 1*a* through the casing 1. An inclined cam groove 12*a* is formed in the drive ring 12, and a bearing 15 is engaged in this inclined cam groove 12*a*. One end of the same bearing is connected to an end portion of the connecting shaft 13.

Therefore, when the drive ring 12 is turned in one direction via the drive ring lever 14, the bearing 15 is displaced in the axial direction so that the connecting shaft 13 is slid axially along the aperture 1*a*. As a result, the diffuser ring 11 is pushed out and moves out to the passage side. Moreover, when the drive ring 12 is rotated in the other direction via the drive ring lever 14, the diffuser ring 11 returns to the original position.

In the aforementioned turbocompressor, there is the problem that since the adjusting mechanism for the diffuser is on a large scale, a large installation space is necessary. Moreover since there are many sliding parts, a large drive force is required. Furthermore high accuracy is necessary in boring the holes in the casing side, and in machining the two rings.

SUMMARY OF THE INVENTION

The present invention takes into consideration the above situation with: an object of making the space necessary for installing the adjusting mechanism for the diffuser small to thereby miniaturize the turbocompressor as well as a refrigerating machine where this turbocompressor is a constituent element; an object of being able to drive the adjusting mechanism of the diffuser with a small drive force to enable energy saving of the turbocompressor and a refrigerating machine incorporating this turbocompressor; and an object of simplifying the construction of the adjusting mechanism of the diffuser to decrease time and labor in machining and thus reduce manufacturing costs.

As a means for solving the abovementioned problems, a turbocompressor and refrigerating machine of the following construction is adopted. That is to say, a turbocompressor according to a first aspect of the invention is one with a diffuser provided around an impeller periphery with one wall which can approach or separate from another wall and spaced apart therefrom with a passage for fluid therebetween, and comprises:

a diffuser ring forming the one wall, arranged so as to be a concentric circle with the surroundings of the impeller and supported on the casing, and which can be rotated in the circumferential direction and which can be moved in an axial direction of the impeller, with a groove formed on an outer peripheral face at an incline to the axial direction of the impeller, a protrusion provided on the casing and fitted into the groove, a shaft axially supported on the diffuser ring, and a drive section for driving the shaft in a lengthwise direction.

In this turbocompressor, when the shaft is driven in the lengthwise direction thereof, the linear motion of the shaft is converted to rotary motion of the diffuser ring, so that the diffuser ring rotates in the circumferential direction. At this time, the protrusion fitted into the groove guides the diffuser ring along the groove. However since the groove is formed at an incline to the axial direction, the diffuser ring also moves in the axial direction in addition to rotating in the circumferential direction. Consequently, when the shaft is moved in one direction, the diffuser ring is pushed in to the passage side while rotating in the circumferential direction, and when moved in the other direction, this moves in reverse returning to the original position.

As a result, the number of ring shape members can be reduced compared to heretofore, and the construction simplified. Therefore there is the effect that, the mechanism itself can be made compact, and due to the decrease in sliding parts, energy losses can be reduced, and due to a reduction in the number of parts, time and labor in processing can be minimized. Moreover, since the diffuser ring is rotated by converting the linear motion of the shaft into rotary motion of the diffuser ring, the diffuser ring can be rotated using a drive section (for example a hydraulic cylinder) which performs simple linear motion. Also due to this, an affect similar to the above can be expected.

The turbocompressor according to a second aspect is characterized in that in the turbocompressor according to the first aspect, there is provided a vane diffuser having a plurality of vanes separated in the circumferential direction, further outside than the diffuser.

In this turbocompressor, since the effect of the diffuser can be adjusted, if a vane diffuser is combined on the outside thereof, then even if the fluid intake flow rate is changed, an optimum diffuser affect is obtained.

A turbocompressor according to a third aspect of the invention is one with a diffuser provided around an impeller periphery with one wall which can approach or separate from another wall and spaced apart therefrom with a passage for fluid therebetween, and comprises:

a diffuser ring forming the one wall, arranged so as to be a concentric circle with the surroundings of the impeller and supported on the casing, and which can be moved in an axial direction of the impeller, a bar with an approximate center thereof supported on the casing and able to swing in an axial direction of the impeller, with one end connected to the diffuser ring, and a drive section for swinging an other end of the bar in the axial direction.

In this turbocompressor, when the other end of the bar is swung, then according to the theory of levers, the one end of the bar swings in the opposite direction so that the diffuser ring connected to this moves in the axial direction. Consequently, when the other end of the bar is swung in one direction, the diffuser ring is pushed in to the passage side. Moreover, when swung in the other direction, this moves in reverse returning to the original position.

A turbocompressor according to a fourth aspect of the invention is one with a diffuser provided around an impeller periphery with one wall which can approach or separate from another wall and spaced apart therefrom with a passage for fluid therebetween, and comprises:

a diffuser ring forming the one wall, arranged so as to be a concentric circle with the surroundings of the impeller and supported on the casing, and which can be moved in an axial direction of the impeller, a shaft supported on the casing and movable in the axial direction, a connecting member for connecting one end of the shaft to the diffuser ring, and a drive section for moving the shaft in the axial direction.

In this turbocompressor, when the shaft is moved in the axial direction of the impeller, this movement is transmitted to the diffuser ring via the connecting member so that the diffuser ring moves in the axial direction. Therefore, when the shaft is moved in one direction, the diffuser ring is pushed in to the passage side. Moreover, when moved in the other direction, this moves in reverse returning to the original position.

A turbocompressor according to a fifth aspect of the invention is one with a diffuser provided around an impeller periphery with one wall which can approach or separate from another wall and spaced apart therefrom with a passage for fluid therebetween, and comprises:

a diffuser ring forming the one wall, arranged so as to be a concentric circle with the surroundings of the impeller and supported on the casing, and which can be rotated in the circumferential direction and which can be moved in an axial direction of the impeller, a shaft arranged in a radial direction of the diffuser ring and supported on the casing and centered on an axis in the radial direction, an eccentric shaft section provided eccentrically on one end of the shaft and rotatably coupled to the diffuser ring, and a drive section for rotating the shaft.

In this turbocompressor, when the shaft is rotated, the eccentric shaft section is eccentrically rotated and the movement thereof is transmitted to the diffuser ring so that the diffuser ring also moves in the axial direction in addition to rotating in the circumferential direction. Consequently, when the shaft is rotated in one direction, the diffuser ring is pushed in to the passage side while rotating in the circumferential direction, and when rotated in the other direction, this moves in reverse returning to the original position.

A turbocompressor according to a sixth aspect of the invention is one with a diffuser provided around an impeller periphery with one wall which can approach or separate from another wall and spaced apart therefrom with a passage for fluid therebetween, and comprises:

a diffuser ring forming the one wall, arranged so as to be a concentric circle with the surroundings of the impeller and supported on the casing, and which can only be moved in an axial direction of the impeller, with a first helical gear section formed on an outer circumferential surface, a shaft supported on the casing and able to rotate about an axis parallel to an axis of the impeller, an arm member secured to one end of the shaft, with a second helical gear section for meshing with the first helical gear section, formed on a tip end, and a drive section for rotating the shaft.

In this turbocompressor, when the shaft is rotated, the arm member swings, and the swinging is transmitted to the diffuser ring via the second helical gear section and the first helical gear section. Here since the diffuser ring can only move in the axial direction of the impeller, the force transmitted via the first and second helical gear sections becomes a component only in the axial direction of the impeller. Consequently, when the shaft is rotated in one direction, the diffuser ring is moved in the axial direction and pushed in to the passage side. Moreover, when rotated in the other direction, this moves in reverse returning to the original position.

A refrigerating machine according to a seventh aspect of the invention, is characterized in comprising: a turbocompressor according to any one of the first, second, third, fourth, fifth and sixth aspects of the invention; a condenser for condensing and liquefying a gaseous refrigerant compressed by the turbocompressor; a metering valve for reducing the pressure of the refrigerant liquefied by the condenser; and an evaporator for performing heat exchange between refrigerant reduced in pressure by the metering valve and a substance to be cooled, to cool the substance to be cooled, and evaporate and gasify the refrigerant.

With this refrigerating machine, in the turbocompressor the aforementioned effect is obtained. Therefore for the refrigerating machine also, the equipment is made compact, energy saved and cost reduced.

DETAILED DESCRIPTION OF THE INVENTION

A first embodiment of a turbocompressor and a refrigerating machine according to the present invention as shown in FIG. 1 through FIG. 6, will now be described.

Figure 1:
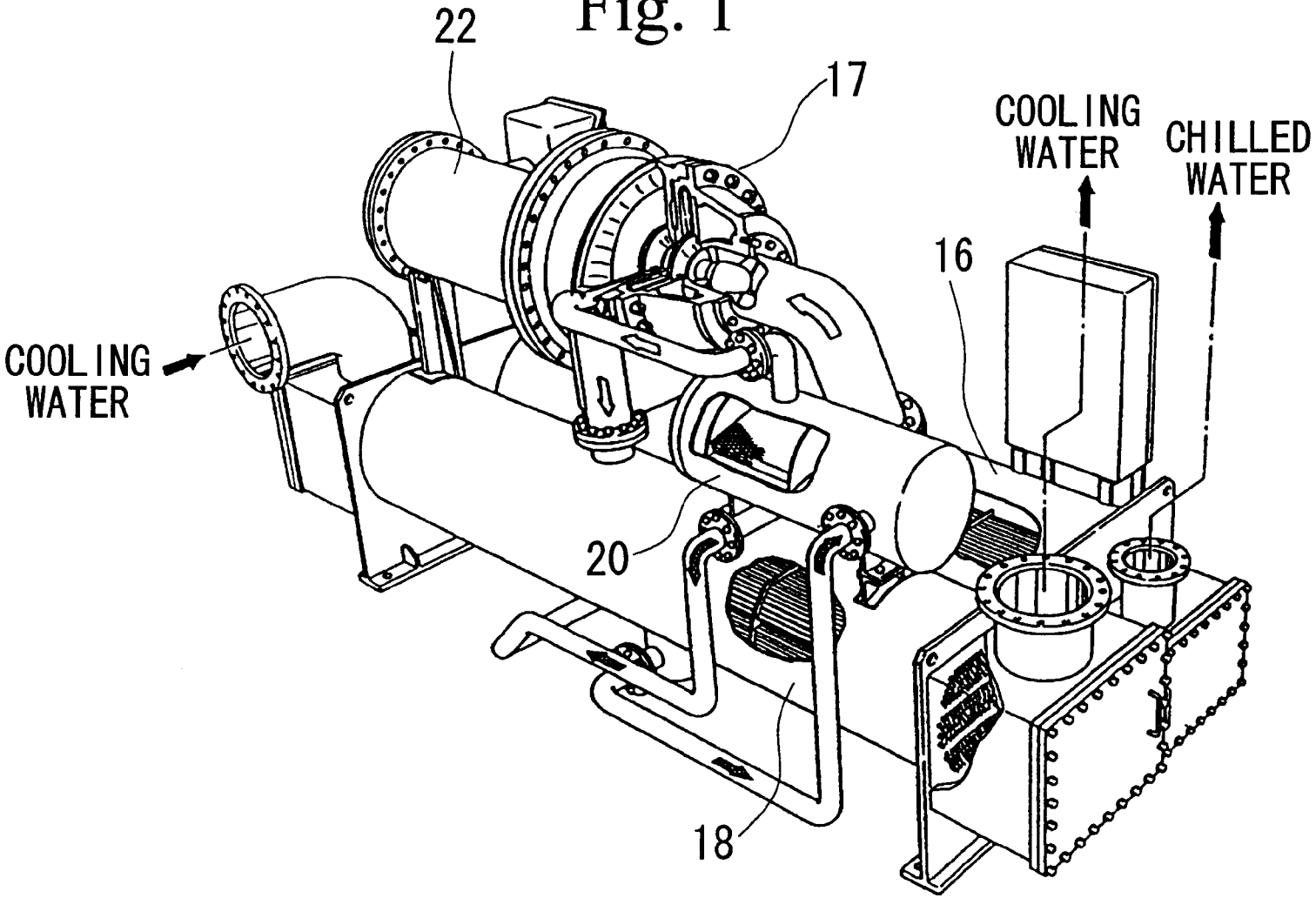
FIG. 1 is a diagram showing a first embodiment according to the present invention, being a perspective view of a refrigerating machine which uses a turbocompressor.
Figure 2:
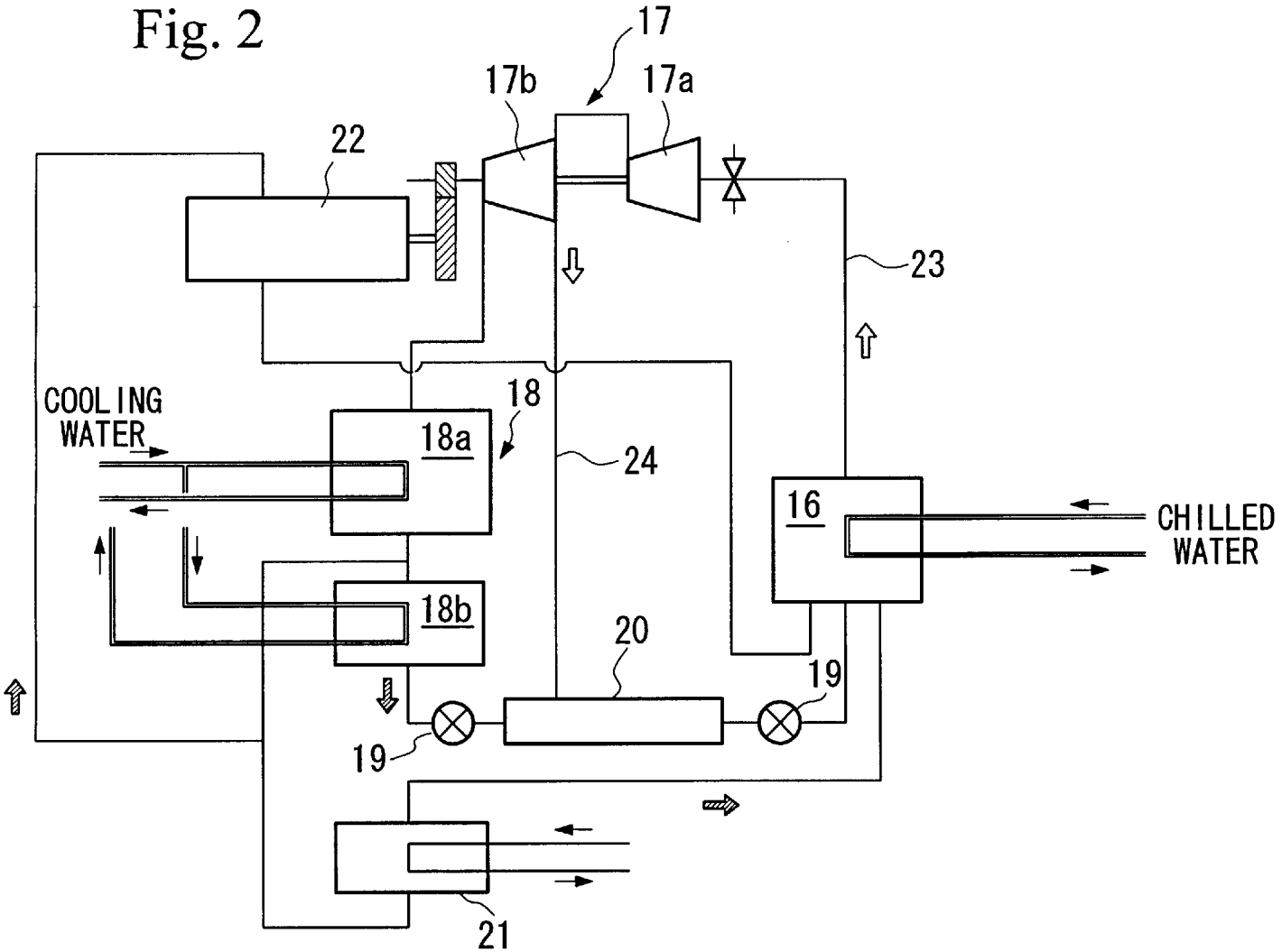
FIG. 2 is a schematic diagram showing a system structure of the refrigerating machine shown in FIG. 1.

The construction of the refrigerating machine according to the first embodiment is shown in FIG. 1 and FIG. 2. The refrigerating machine shown in the figures incorporates: an evaporator 16 for performing heat exchange between a refrigerant and chilled water for cooling the chilled water and evaporating and gasifying the refrigerant, a compressor 17 for compressing the refrigerant gasified in the evaporator 16, a condenser 18 for performing heat exchange between the refrigerant compressed in the compressor 17 and a cooling water and condensing and liquefying the refrigerant, a metering valve 19 for reducing the pressure of the refrigerant liquefied in the condenser 18, an intercooler 20 for temporarily accumulating and cooling the refrigerant liquefied in the condenser 18, and an oil cooler 21 for cooling lubricant for the compressor 17 using a part of the refrigerant cooled in the condenser 18. Furthermore, a motor 22 is connected to the compressor 17 for driving this.

The evaporator 16, the compressor 17, the condenser 18, the metering valve 19 and the intercooler 20 are connected together by a primary line to make up a closed system in which the refrigerant is circulated.

For the compressor 17, a two stage turbocompressor is adopted. Gaseous refrigerant is compressed by a first stage impeller 17*a*, and this refrigerant is introduced to a second stage impeller 17*b* and further compressed and then delivered to the condenser 18.

The condenser 18 comprises a main condenser 18*a* and an auxiliary condenser 18*b* referred to as a subcooler. The refrigerant is introduced in sequence from the main condenser 18*a* to the subcooler 18*b*, however in the main condenser 18*a*, a part of the cooled refrigerant is introduced to the oil cooler 21 without passing through the subcooler 18*b*, to cool the lubricating oil. Furthermore, separate to this, in the main condenser 18*a*, a part of the cooled refrigerant is introduced to inside the casing of the motor 22 without passing through the subcooler 18*b*, to cool the stator and coil (omitted from the figure).

Metering valves 19 are respectively installed between the condenser 18 and the intercooler 20, and between the intercooler 20 and the evaporator 16, so that the refrigerant liquefied in the condenser 18 is pressure reduced in stages.

The construction of the intercooler 20 is equivalent to a hollow container, and the refrigerant which is cooled in the condenser 18 and the subcooler 18*b*, and pressure reduced in the metering valve 19 is temporarily accumulated to further promote cooling. The vapor phase component inside the intercooler 20 is introduced to a second stage impeller 17*b* of the compressor 17 via a bypass pipe 24 without passing through the evaporator 16.

Figure 3:
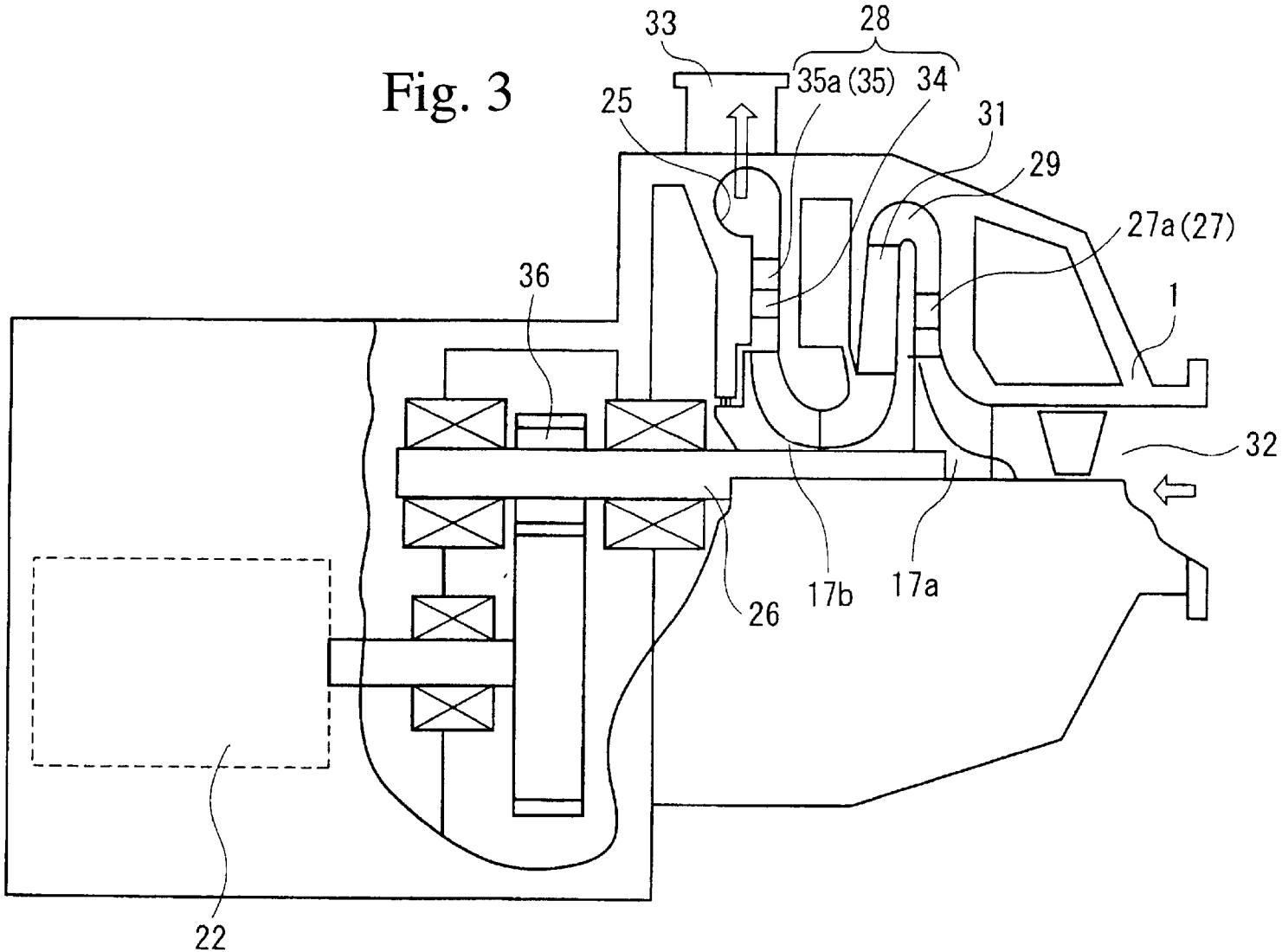
FIG. 3 is a cross-section view of a compressor.

FIG. 3 shows the internal construction of the compressor 17. In the figure, reference symbol 25 denotes a casing, 26 a main shaft, 27 a first stage diffuser section, 28 a second stage diffuser section, 29 a return bend, 31 guide vanes, 32 an inlet port and 33 a discharge port. The first stage diffuser section 27 comprises a vane diffuser having a plurality of vanes 27*a* which are arranged spaced at equal intervals on an outer peripheral portion of the first stage impeller 17*a*. In the second stage diffuser section 28 are installed in combination; a diffuser 34 having no vanes arranged in a concentric circular shape on the outer periphery of the second stage impeller 17*b*, and a vane diffuser 35 having a plurality of vanes 35*a* arranged spaced at equal intervals on the outer periphery of the diffuser 34. Furthermore, there is provided a gear mechanism 36 for transmitting a drive force from the motor 22.

In the compressor 17, the first stage impeller 17*a* and the second stage impeller 17*b* are both secured to the main shaft 26, and are rotated by the motor 22, so that gaseous refrigerant which is drawn in from the inlet port 32, is compressed (increased in pressure) and then discharged from the discharge port 33.

The gaseous refrigerant which is drawn in from the inlet port 32 with rotation of the first stage impeller 17*a*, has the velocity and pressure thereof increased by the operation of the first stage impeller 17*a*. The velocity is then slowed in the course of passing through the first stage diffuser section 27 so that the kinetic energy is converted into internal energy. Then, after dropping in pressure with sequential passing through the return bend 29 and the guide vanes 31, this is guided into the entrance of the second stage impeller 17*b*. The gaseous refrigerant which has-been drawn in by the rotation of the second stage impeller 17*b*, when passing through the second stage impeller 17*b* is further reduced in pressure via a similar passage, and by the process of passing through the second stage diffuser section 28, the velocity is again slowed down and the kinetic energy converted into internal energy, after which this is discharged from the discharge port 33.

In the compressor 17, one wall portion 34*a* constituting the diffuser 34 is made so as to be able to approach and separate from the other wall 34*b*, so that the effect of the diffuser 34 can be adjusted. Hence even if this is combined with the latter stage vane diffuser 35, and the intake flow rate of the fluid changes, an optimum diffuser effect is obtained.

Figure 4:
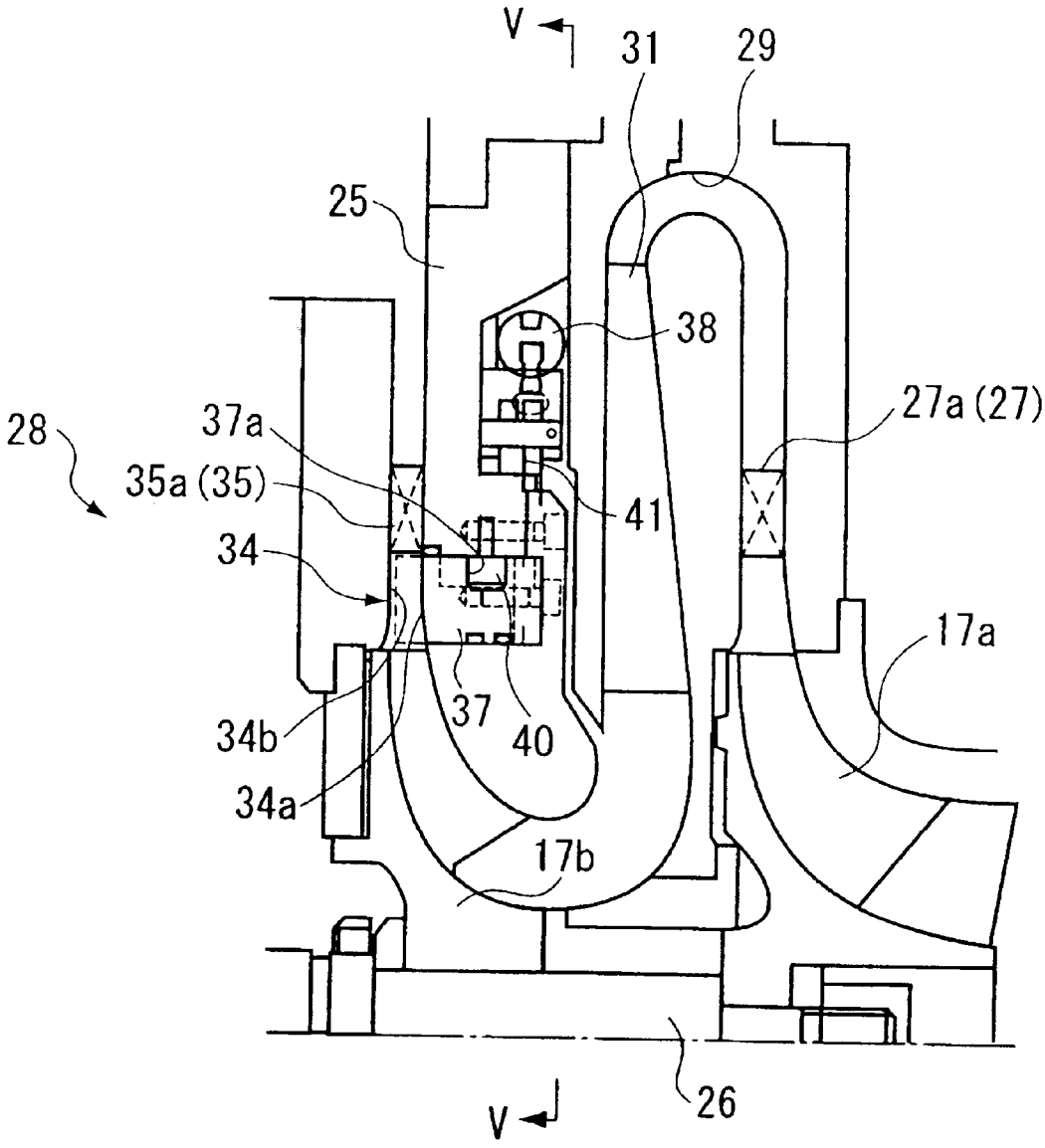
FIG. 4 is a cross-section view showing an adjusting mechanism of a diffuser.
Figure 5:
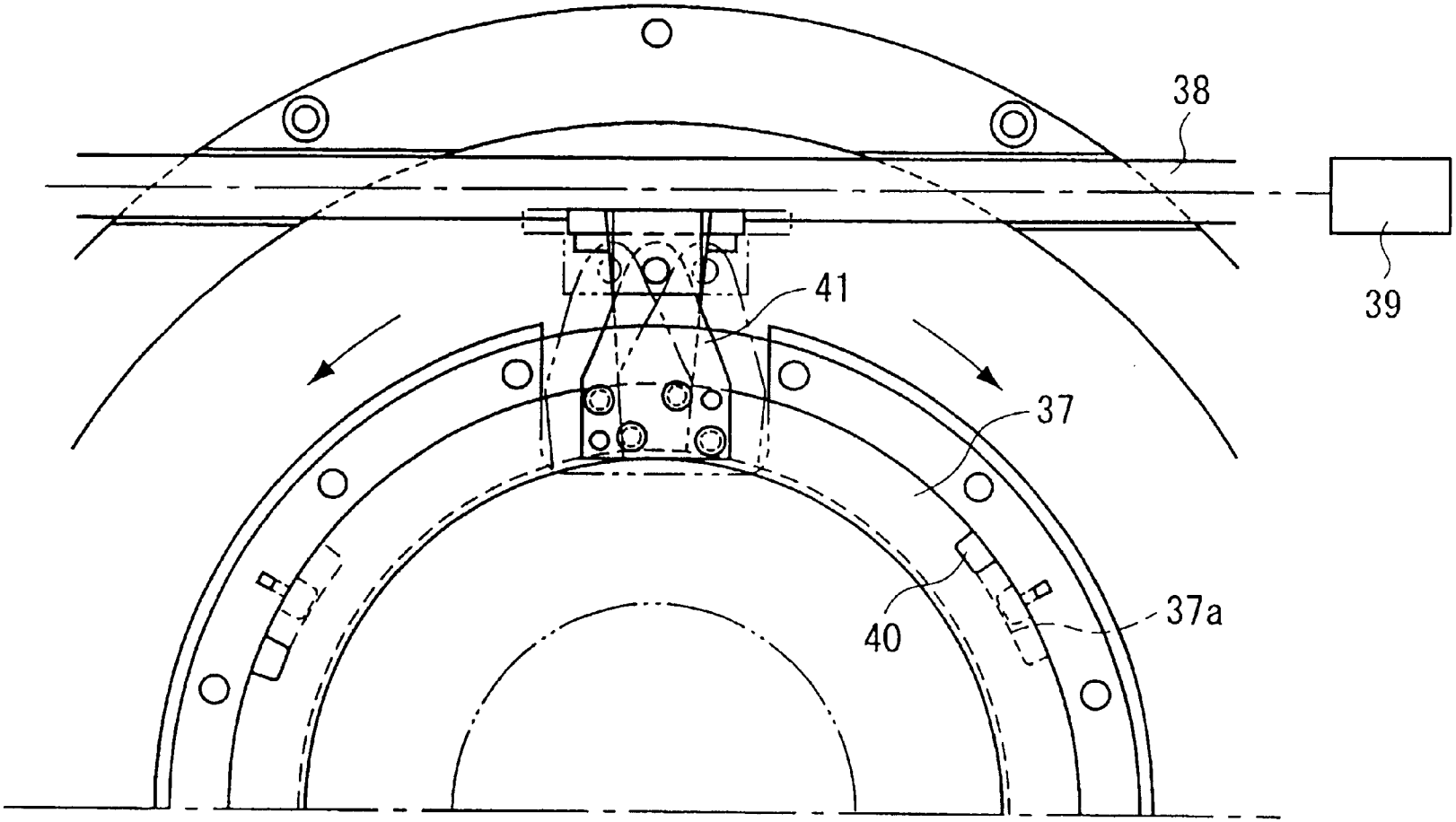
FIG. 5 is a view on line V—V in FIG. 4.

FIG. 4 and FIG. 5 show an adjusting mechanism of the diffuser 34. In the figures, reference symbol 37 denotes a diffuser ring, 38 a shaft, and 39 a drive section. In the diffuser ring 37 one side face constitutes a wall portion 34*a*, and this wall portion 34*a* is exposed to the passage and is built in to the casing 25, and is supported so as to be able to rotate in the circumferential direction and be able to move in the longitudinal direction of the main shaft 26.

Figure 6:
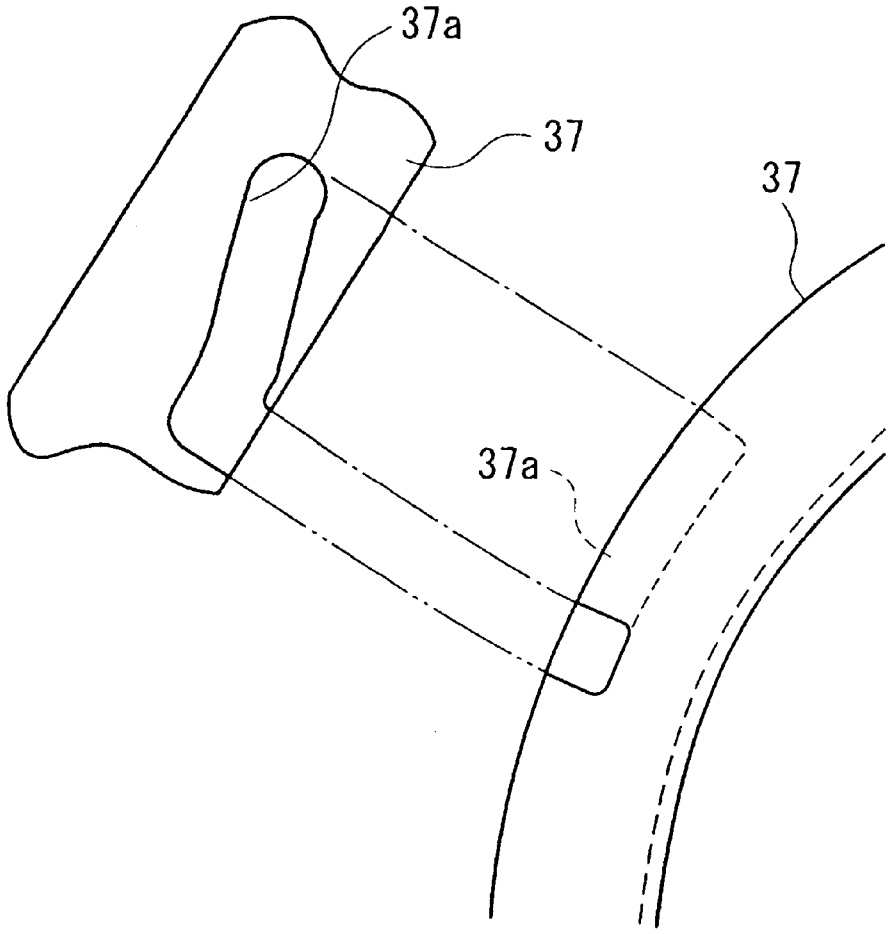
FIG. 6 is a side view and plan view showing the shape of a groove formed in a diffuser ring.

In the outer peripheral face of the diffuser ring 37, as shown in FIG. 6, a groove 37*a* inclined with respect to the lengthwise direction of the main shaft 26, is formed at three locations at even spacing around the circumference. Furthermore in the casing 25, protrusions 40 are provided at three locations corresponding to the groove 37*a*, for fitting into the grooves 37*a* when the diffuser ring 37 is assembled as described above. In order to suppress rubbing contact with the grooves 37*a*, a bearing is provided for each protrusion 40.

The shaft 38 is linked to the diffuser ring 37 via a bracket 41 attached to the diffuser ring and protruding outward. The shaft 38 is rotatably supported relative to the bracket 41, and is driven so as to move back and forth in the lengthwise direction by the drive section 39.

In the adjusting mechanism of the diffuser 34, when the shaft 38 is driven in the lengthwise direction, the linear motion of the shaft 38 is changed to rotary motion of the diffuser ring 37 so that the diffuser ring 37 rotates in the circumferential direction. At this time, the protrusions 40 fitted into the grooves 37*a*, guide the diffuser ring 37 along the grooves, however since the grooves 37*a* are formed at an incline with respect to the lengthwise direction of the main shaft 26, the diffuser ring 37 is also moved along the lengthwise direction of the main shaft 26 in addition to the rotation in the circumferential direction. Consequently, when the shaft 38 is moved in one direction, the diffuser ring 37 is rotated in the circumferential direction and at the same time is pushed in to the passage side so that the one wall 34*a* approaches the other wall 34*b*. Moreover, when driven in the other direction, this moves in reverse so that the one wall 34*a* is moved away from the other wall 34*b* and returns to the original position.

In the drive section 39, a cylinder mechanism for pushing and pulling the shaft 38 in the lengthwise direction may be adopted, or a rack may be formed on the shaft 38 and this may be engaged with a pinion rotated with a motor or the like, so that the shaft 38 is moved in the lengthwise direction.

Figure 7:
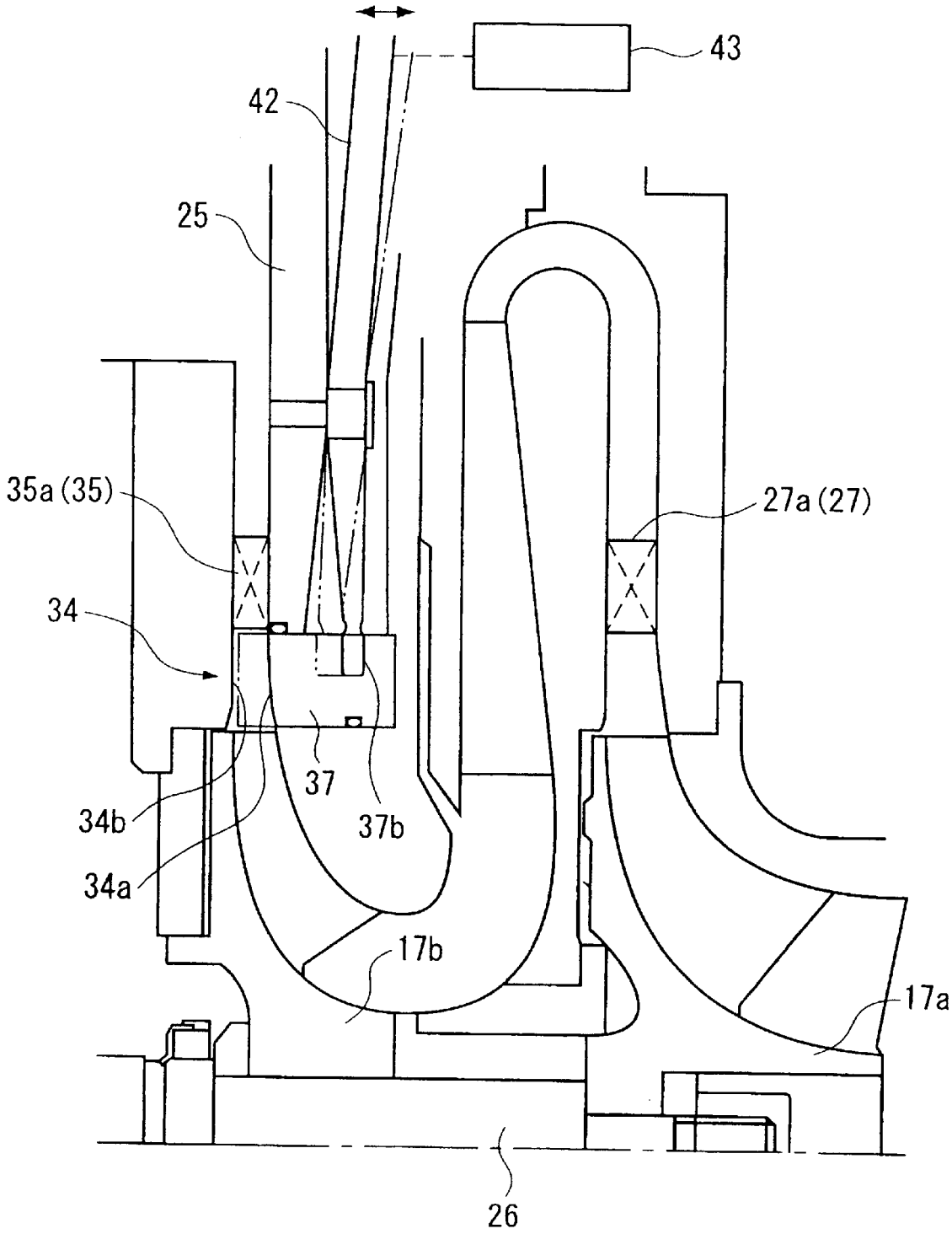
FIG. 7 is a view showing a second embodiment according to the present invention, being a cross-section view showing an adjusting mechanism of a diffuser.

A second embodiment of a turbocompressor and a refrigerating machine according to the present invention as shown in FIG. 7, will now be described. Components already described for the first embodiment are denoted by the same reference symbols and description is omitted.

FIG. 7 shows an adjusting mechanism of the diffuser 34. In this figure, reference symbol 42 denotes a bar, and 43 a drive section. Furthermore, the diffuser ring 37 in this embodiment is only moveable in the lengthwise direction of the main shaft 26.

The bar 42 is pivotally supported at an approximate center on the casing 25 so as to be able to swing. One end of the bar 42 is fitted loosely into an aperture 37*b* formed in the diffuser ring 37, while the other end of the bar 42 is connected to the drive section 43. The drive section 43 pushes and pulls the other end of the bar 42 to thereby swing the bar 42.

In the adjusting mechanism of the diffuser 34, when the drive section 43 is operated so that the other end of the bar 42 is swung, the one end of the bar 42 swings in the opposite direction according to the theory of levers, so that the diffuser ring 37 connected to the one end of the bar 42 moves in the lengthwise direction of the main shaft 26. Consequently, when the other end of the bar 42 is swung in one direction, the diffuser ring 37 is pushed in to the passage side and the one wall 34*a* approaches the other wall 34*b*. Moreover, when moved in the other direction, this moves in reverse so that the one wall 34*a* is moved away from the other wall 34*b* and returns to the original position.

Figure 8:
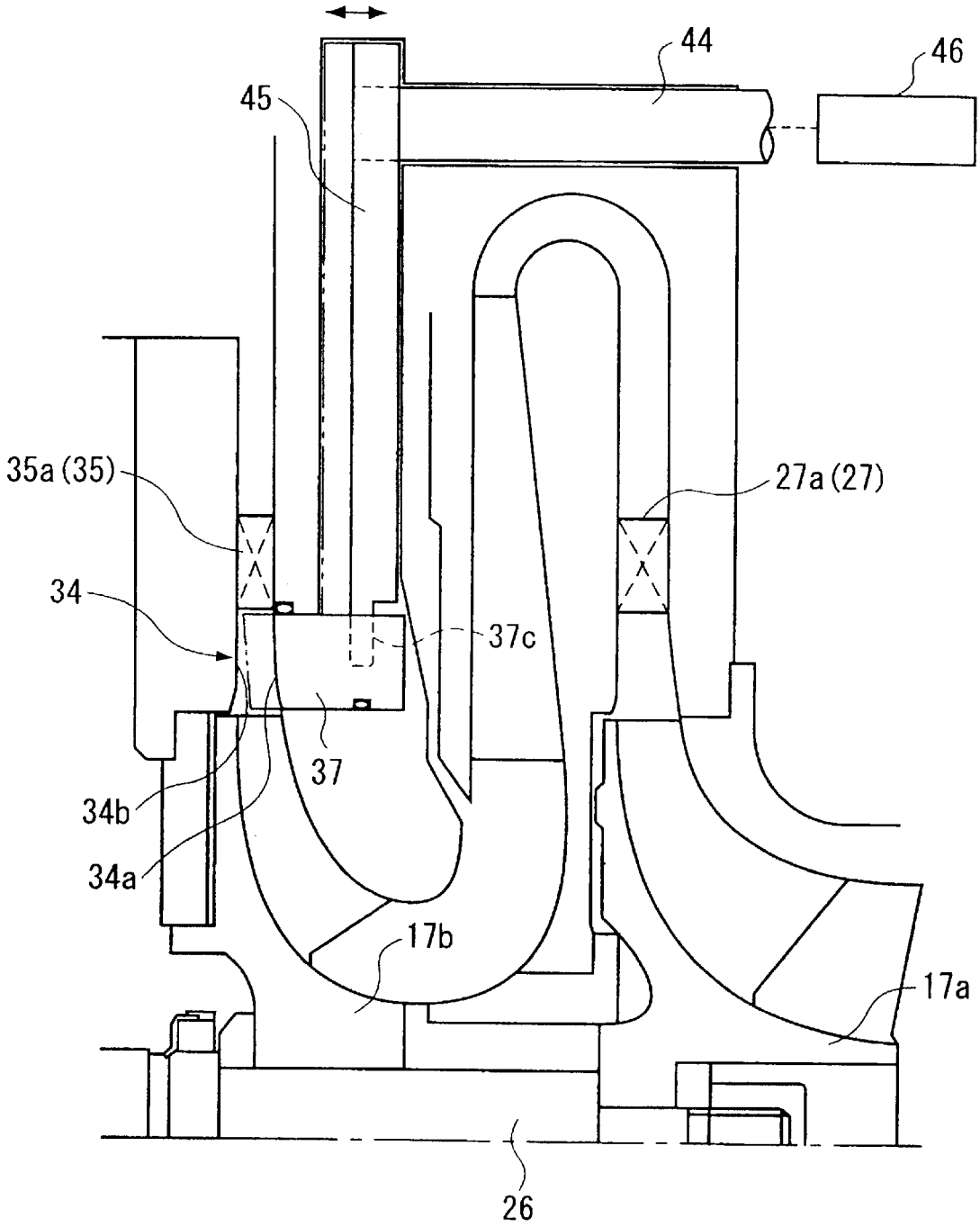
FIG. 8 is a view showing a third embodiment according to the present invention, being a cross-section view showing an adjusting mechanism of a diffuser.

A third embodiment of a turbocompressor and a refrigerating machine according to the present invention as shown in FIG. 8, will now be described. Components already described for the aforementioned embodiments are denoted by the same reference symbols and description is omitted.

FIG. 8 shows an adjusting mechanism of the diffuser 34. In the figure, reference symbol 44 denotes a shaft, 45 a connection member, and 46 a drive section. Furthermore, the diffuser ring 37 in this embodiment is only moveable in the lengthwise direction of the main shaft 26.

The shaft 44 is supported on the casing 25 further outside than the return bend 29, and is movable parallel to the lengthwise direction of the main shaft 26. One end of the shaft 44 is connected to the diffuser ring 37 via the connection member 45, while the other end of the shaft 44 is connected to the drive section 46. The drive section 46 pushes and pulls the other end of the shaft 44 so as to move the shaft 44 back and forth in the lengthwise direction.

In the adjusting mechanism of the diffuser 34, when the drive section 46 is operated so that the shaft 44 is moved in the lengthwise direction of the main shaft 26, this movement is transmitted to the diffuser ring 37 via the connection member 45, and the diffuser ring 37 moves in the lengthwise direction of the main shaft 26. Consequently, when the shaft 44 is moved in one direction, the diffuser ring 37 is pushed in to the passage side and the one wall 34*a* approaches the other wall 34*b*. Moreover, when moved in the other direction, this moves in reverse so that the one wall 34*a* is moved away from the other wall 34*b* and returns to the original position.

Figure 9:
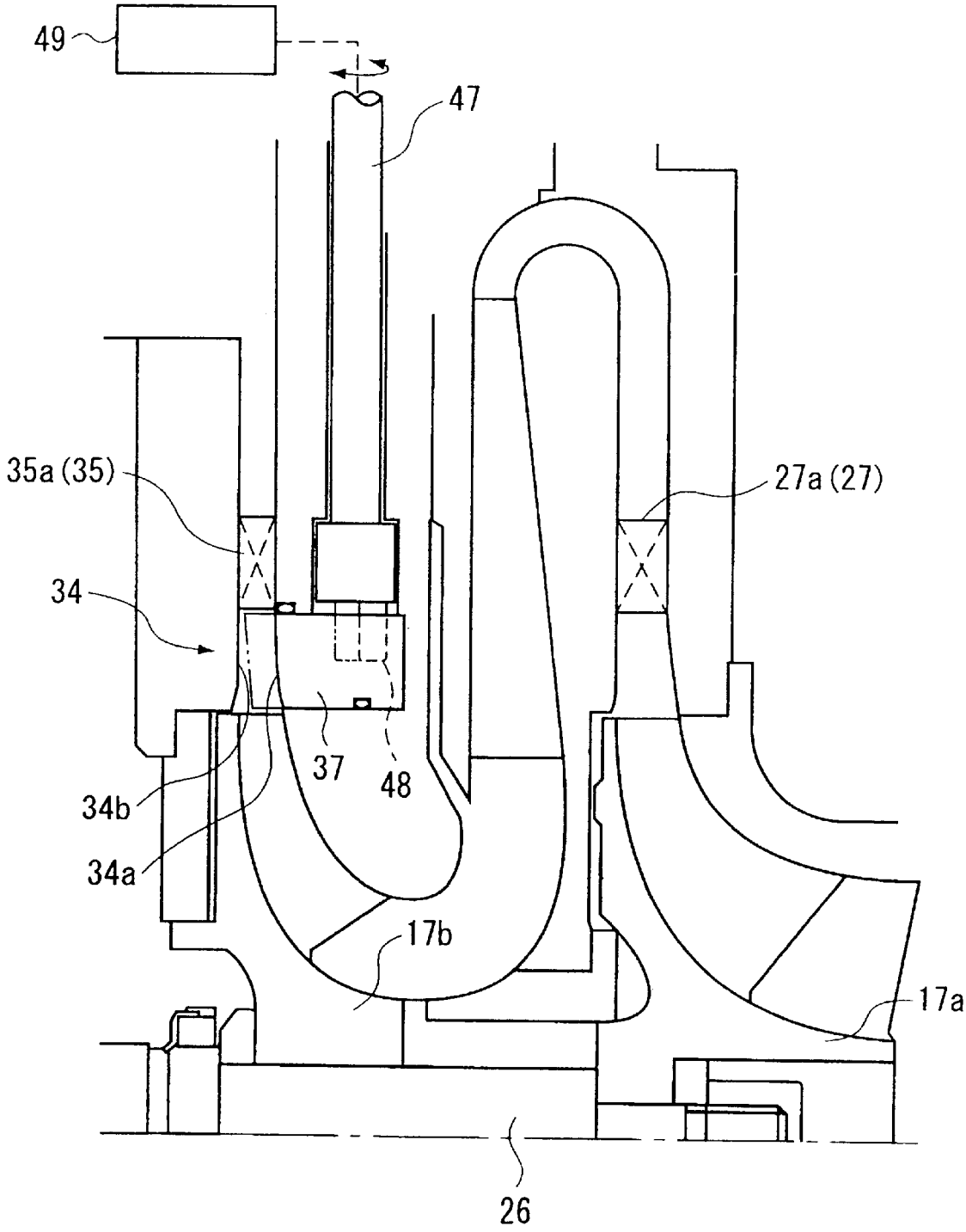
FIG. 9 is a view showing a fourth embodiment according to the present invention, being a cross-section view showing an adjusting mechanism of a diffuser.

A fourth embodiment of a turbocompressor and a refrigerating machine according to the present invention as shown in FIG. 9, will now be described. Components already described for the aforementioned embodiments are denoted by the same reference symbols and description is omitted.

FIG. 9 shows an adjusting mechanism of the diffuser 34. In the figure, reference symbol 47 denotes a shaft, 48 an eccentric shaft, and 49 a drive section. Furthermore, the diffuser ring 37 in this embodiment is rotatable in the circumferential direction and movable in the lengthwise direction of the main shaft 26.

The shaft 47 is disposed outward of the diffuser ring 37 directed in the radial direction thereof and supported on the casing 25, so as to be rotatable about its own axis which is directed in the radial direction of the diffuser ring 37. The eccentric shaft 48 is eccentrically provided at one end of the shaft 47 adjacent to the outer peripheral face of the diffuser ring 37, and is fitted into a hole 37*c* formed in the diffuser ring 37 so as to be rotatable therein. The drive section 49 is connected to the other end of the shaft 47, so as to rotate the shaft 47.

In the adjusting mechanism of the diffuser 34, when the drive section 49 is operated to rotate the shaft 47, the eccentric shaft 48 rotates eccentrically, and the rotation movement is transmitted to the diffuser ring 37, so that the diffuser ring 37 as well as rotating in the circumferential direction is also moved in the lengthwise direction of the main shaft 26. Consequently, when the shaft 47 is rotated in one direction, the diffuser ring 37 is pushed in to the passage side and the one wall 34*a* approaches the other wall 34*b*. Moreover, when rotated in the other direction, this moves in reverse so that the one wall 34*a* is moved away from the other wall 34*b* and returns to the original position.

Figure 10:
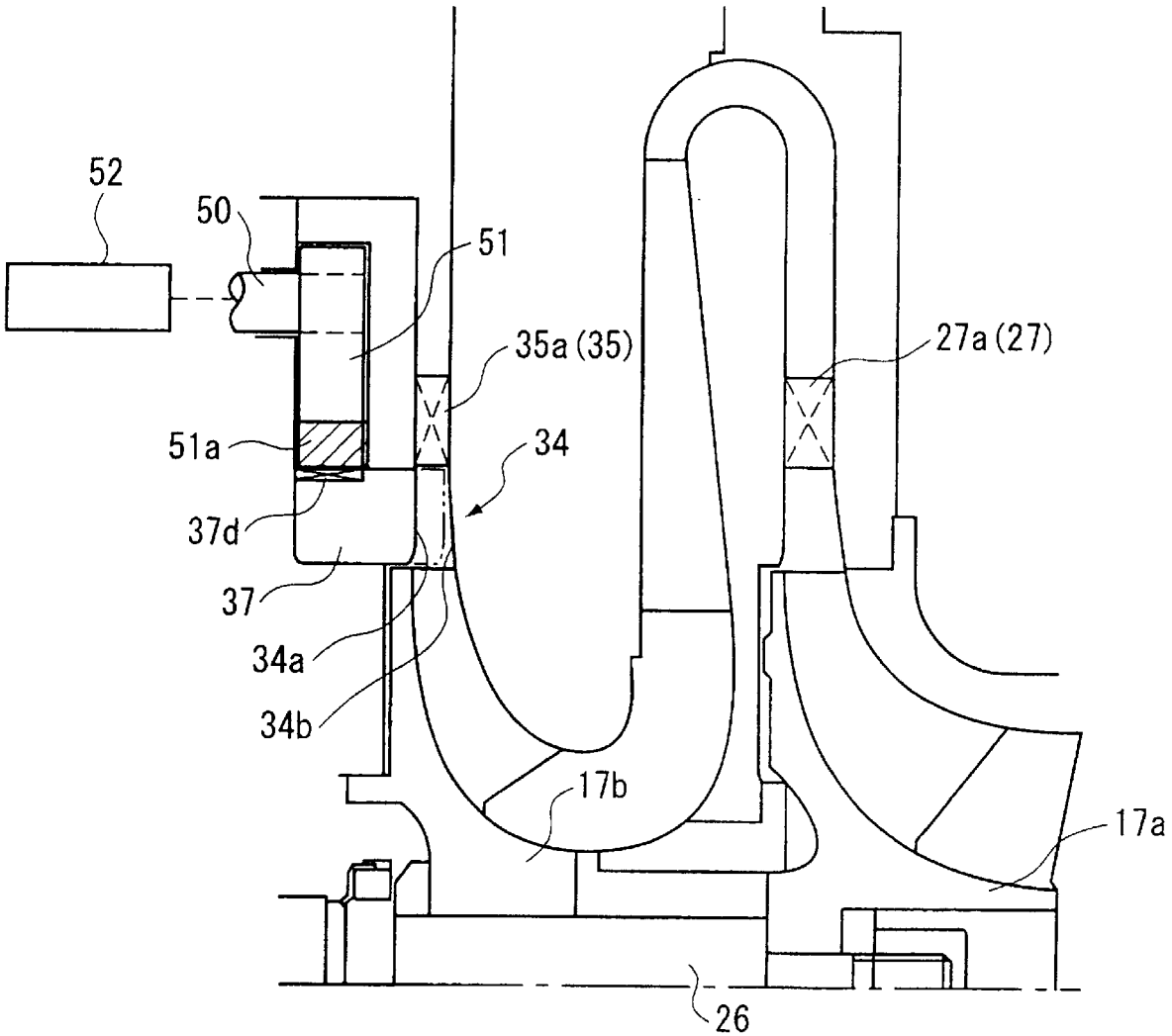
FIG. 10 is a view showing a fifth embodiment according to the present invention, being a cross-section view showing an adjusting mechanism of a diffuser.
Figure 11:
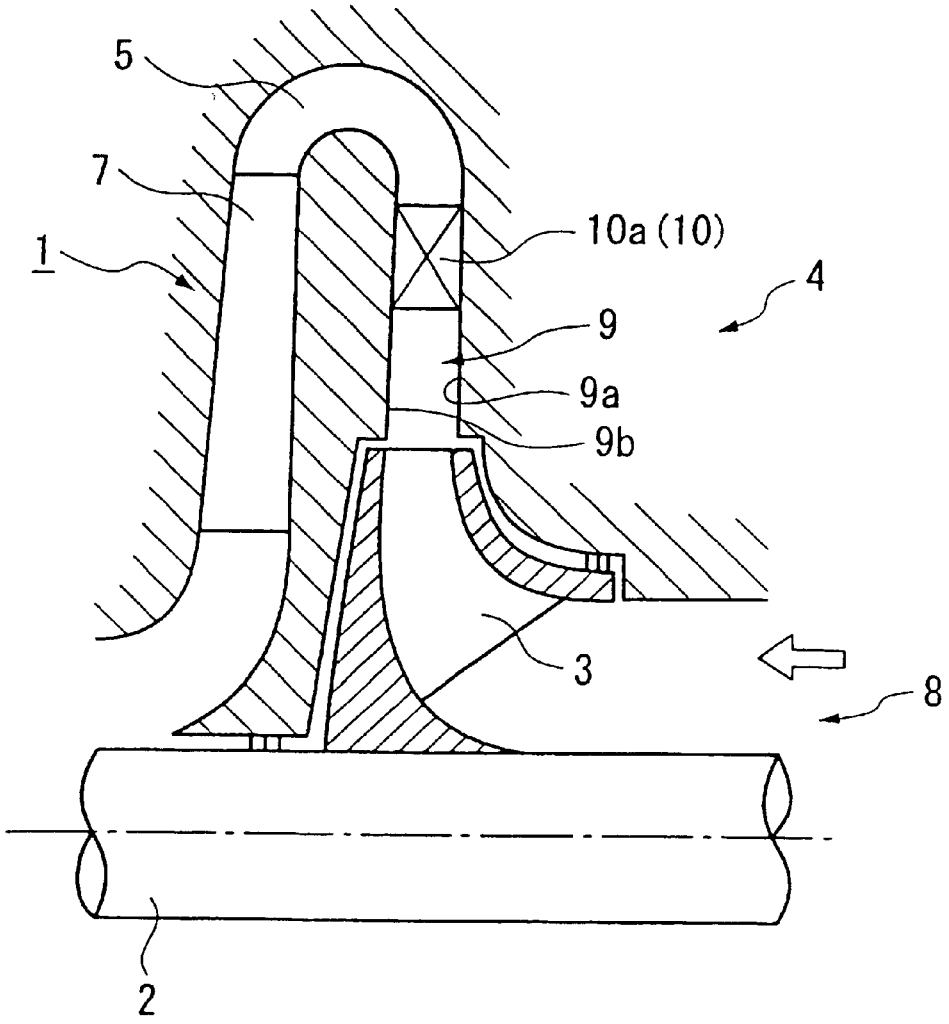
Fig. 11 PRIOR ART
FIG. 11 is a cross-section view showing an example of a conventional compressor.
Figure 12:
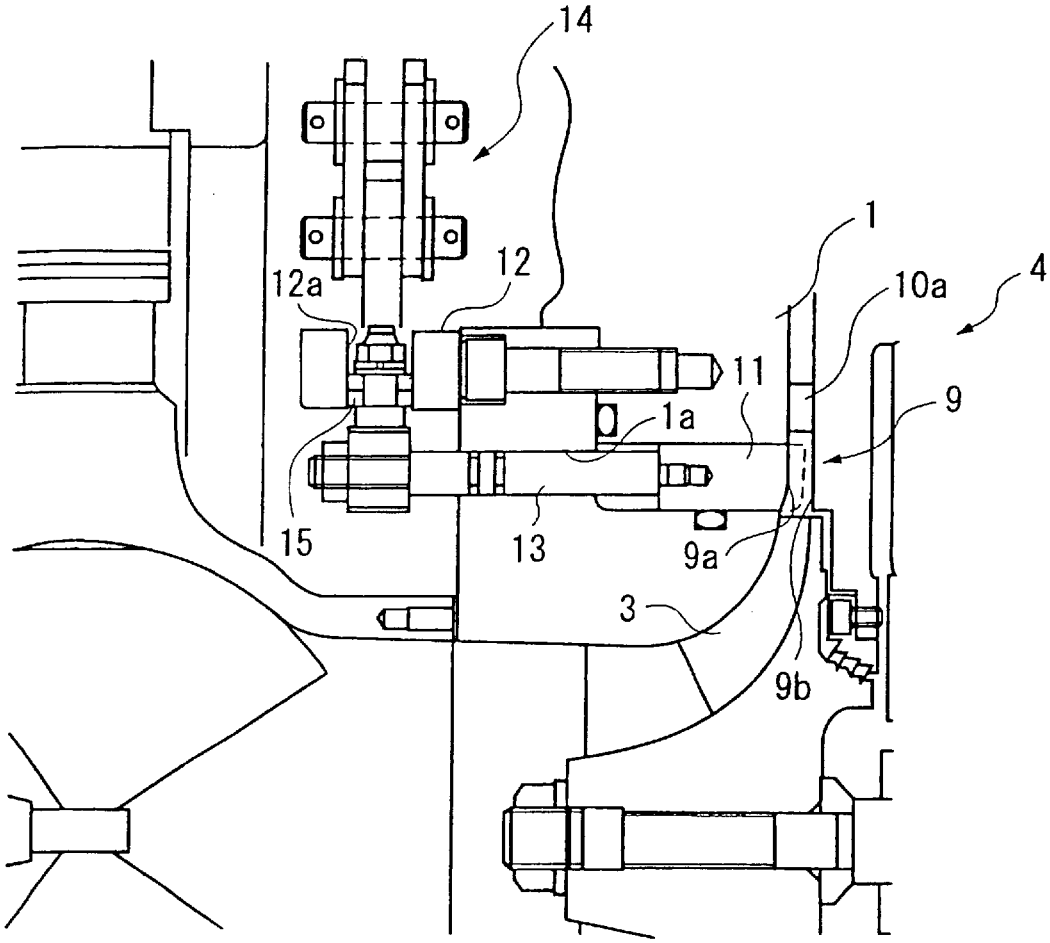
Fig. 12 PRIOR ART
FIG. 12 is a cross-section view showing an adjusting mechanism of a diffuser in the conventional compressor.

A fifth embodiment of a turbocompressor and a refrigerating machine according to the present invention as shown in FIG. 10, will now be described. Components already described for the aforementioned embodiments are denoted by the same reference symbols and description is omitted.

FIG. 10 shows an adjusting mechanism of the diffuser 34. In the figure, reference symbol 50 denotes a shaft, 51 an arm section, and 52 a drive section. Furthermore, the diffuser ring 37 in this embodiment is moveable in the lengthwise direction of the main shaft 26. Moreover, a first helical gear section 37*d* is formed on the outer peripheral face.

The shaft 50 is disposed further outside than the diffuser ring 37 parallel with the lengthwise direction of the main shaft 26, and supported on the casing 25 so as to be rotatable about its own axis which is directed in the axial direction of the main shaft 26. The arm section 51 is secured to one end of the shaft 50 so that with rotation of the shaft 50 the tip end swings. Furthermore, a second helical gear section 51*a* is formed on the tip end of the arm section 51 and this is meshed with the first helical gear section 37*d*.

In the adjusting mechanism of the diffuser 34, when the drive section 52 is operated to rotate the shaft 50, the arm section 51 swings, and this swinging is transmitted to the diffuser ring 37 via the second helical gear section 51*a* and the first helical gear section 37*d*. Here, since the diffuser ring 37 is only moveable in the lengthwise direction of the main shaft 26, the force transmitted via the second and first helical gear sections 51*a* and 37*d* becomes just a component in the lengthwise direction of the main shaft 26. Consequently, when the shaft 50 is rotated in one direction, the diffuser ring 37 is pushed in to the passage side and the one wall 34*a* approaches the other wall 34*b*. Moreover, when rotated in the other direction this moves in reverse so that the one wall 34*a* is moved away from the other wall 34*b* and returns to the original position.

As described above, in the turbocompressor according to the present invention, the linear motion of the shaft is converted directly into rotary motion of the diffuser ring, and due to the relationship between the groove and the protrusion, the diffuser ring moves in the axial direction while rotating. Therefore it becomes possible to move the diffuser in the axial direction using a drive section which performs simple linear motion. As a result, the number of ring shape members can be reduced compared to heretofore, and the construction simplified. Therefore the effect is obtained that, the mechanism itself can be made compact, and due to a decrease in sliding parts, energy losses can be reduced, and due to a reduction in the number of parts, time and labor in processing can be minimized.

According to the turbocompressor of the second aspect, since the effect of the diffuser can be adjusted, if a vane diffuser is combined on the outside thereof, then even if the fluid intake flow rate is changed, an optimum diffuser affect is obtained.

In the turbocompressor of the third aspect, by swinging the bar, the diffuser ring can be moved in the axial direction. Therefore the diffuser ring can be moved in the axial direction using a drive section which performs simple linear motion. As a result an affect similar to the above is obtained.

According to the turbocompressor of the fourth aspect, by moving the shaft in the axial direction of the impeller, the diffuser ring is moved in the axial direction. Therefore, the diffuser ring can be moved in the axial direction using a drive section which performs simple linear motion. As a result, an affect similar to the above is obtained.

According to the turbocompressor of the fifth aspect, by rotating the shaft, the diffuser ring is moved in the axial direction. Therefore the diffuser can be moved in the axial direction using a drive section which performs simple rotary motion. As a result, an affect similar to the above is obtained.

According to the turbocompressor of the sixth aspect, by rotating the shaft, the diffuser ring is moved in the axial direction. Therefore the diffuser ring can be moved in the axial direction using a drive section which performs simply rotary motion. As a result, an affect similar to the above is obtained.

According to the refrigerating machine of the seventh aspect, for the turbocompressor the aforementioned affect is obtained. Therefore for the refrigerating machine also, it is possible to realize compactness of the equipment, energy saving, and low cost.

What is claimed is:

1. A turbocompressor with a diffuser provided around an impeller periphery with one wall which can approach or separate from another wall and spaced apart therefrom with a passage for fluid therebetween, comprising:

a diffuser ring forming said one wall, arranged so as to be a concentric circle with the surroundings of said impeller and supported on the casing, and which can be rotated in the circumferential direction and which can be moved in an axial direction of said impeller, with a groove formed on an outer peripheral face at an incline to the axial direction of said impeller, a protrusion provided on said casing and fitted into said groove, a shaft axially supported on said diffuser ring, and a drive section for driving said shaft in a lengthwise direction.

2. A turbocompressor according to claim 1, wherein there is provided a vane diffuser having a plurality of vanes separated in the circumferential direction, further outside than said diffuser.

3. A turbocompressor with a diffuser provided around an impeller periphery with one wall which can approach or separate from another wall and spaced apart therefrom with a passage for fluid therebetween, comprising:

a diffuser ring forming said one wall, arranged so as to be a concentric circle with the surroundings of said impeller and supported on the casing, and which can be moved in an axial direction of said impeller, a bar with an approximate center thereof supported on said casing and able to swing in an axial direction of said impeller, with one end connected to said diffuser ring, and a drive section for swinging an other end of said bar in said axial direction.

4. A turbocompressor with a diffuser provided around an impeller periphery with one wall which can approach or separate from another wall and spaced apart therefrom with a passage for fluid therebetween, comprising:

a diffuser ring forming said one wall, arranged so as to be a concentric circle with the surroundings of said impeller and supported on the casing, and which can be rotated in the circumferential direction and which can be moved in an axial direction of said impeller, a shaft arranged in a radial direction of said diffuser ring and supported on said casing and centered on an axis in said radial direction, an eccentric shaft section provided eccentrically on one end of said shaft and rotatably coupled to said diffuser ring, and a drive section for rotating said shaft.

5. A turbocompressor with a diffuser provided around an impeller periphery with one wall which can approach or separate from another wall and spaced apart therefrom with a passage for fluid therebetween, comprising:

a diffuser ring forming said one wall, arranged so as to be a concentric circle with the surroundings of said impeller and supported on the casing, and which can only be moved in an axial direction of said impeller, with a first helical gear section formed on an outer circumferential surface, a shaft supported on said casing and able to rotate about an axis parallel to an axis of said impeller, an arm member secured to one end of said shaft, with a second helical gear section for meshing with said first helical gear section, formed on a tip end, and a drive section for rotating said shaft.

6. A refrigerating machine comprising:

a turbocompressor according to any one of claim 1, claim 2, claim 3, claim 4 or claim 5;

a condenser for condensing and liquefying a gaseous refrigerant compressed by said turbocompressor;

a metering valve for reducing the pressure of the refrigerant liquefied by said condenser; and an evaporator for performing heat exchange between refrigerant reduced in pressure by said metering valve and a substance to be cooled, to cool said substance to be cooled, and evaporate and gasify said refrigerant.

* * * * *